US005249668A

United States Patent [19]

Fenton et al.

[11] Patent Number: 5,249,668

[45] Date of Patent: Oct. 5, 1993

[54] METHOD AND APPARATUS FOR TRANSPORTING AND DISPLAYING NECKTIES

[75] Inventors: Frank Fenton, Edison, N.J.; Jeffrey Spiegel, New York, N.Y.; Thomas Shea, Norwalk, Conn.; Lawrence Stuart, Morristown, N.J.

[73] Assignee: Randa Corporation, New York, N.Y.

[21] Appl. No.: 912,984

[22] Filed: Jul. 14, 1992

[51] Int. Cl.[5] ..... B65D 85/62

[52] U.S. Cl. ..... 206/45.14; 206/44 R; 206/278; 206/279; 206/296; 211/70

[58] Field of Search ..... 206/44 R, 45.14, 278, 206/279, 292, 296, 297; 211/13, 70

[56] References Cited

U.S. PATENT DOCUMENTS

| | | | |
|---|---|---|---|
| 1,353,974 | 9/1920 | Smith | 206/45.14 |
| 2,459,417 | 1/1949 | Dodge . | |
| 2,797,030 | 6/1957 | Millhuff . | |
| 2,977,001 | 3/1961 | Vitale . | |
| 3,037,617 | 6/1962 | Collin | 206/279 |
| 3,057,461 | 10/1962 | Richer | 206/279 |
| 3,133,643 | 5/1964 | Lester . | |
| 3,225,977 | 12/1965 | Gandy . | |
| 3,228,738 | 1/1966 | Koffler . | |
| 3,289,985 | 12/1966 | Sheiman . | |
| 3,896,931 | 7/1975 | Franklin . | |
| 3,978,594 | 9/1976 | Pulitzer et al. . | |
| 4,700,847 | 10/1987 | Shieh | 206/45.14 |
| 4,709,838 | 12/1987 | Campbell . | |

FOREIGN PATENT DOCUMENTS

| | | | |
|---|---|---|---|
| 0458862 | 4/1928 | Fed. Rep. of Germany | 206/45.14 |
| 0325767 | 2/1930 | United Kingdom | 206/292 |

*Primary Examiner*—Jimmy G. Foster

*Attorney, Agent, or Firm*—Hoffman, Wasson & Gitler

[57] ABSTRACT

A revolvable rack for neckties that can be either temporarily or permanently hooked or fastened to a rod or a store fixture, and a container for shipping the rack while it is fully loaded with ties. The rack is easily rotated by hand, has a relatively small turning radius and has the capacity to hold several dozen ties. Once the tie rack is placed in the container, the container serves to both store and protect the ties in an organized and out-of-the-way manner. The tie rack and container combination can be hung together in an existing space. The container allows the fully loaded tie rack to be quickly and easily lifted out of the container in one smooth motion, and directly hung on a rod or on a merchandising fixture in a store without the use of special tools or equipment, such that the ties are readily and pleasingly displayed.

8 Claims, 6 Drawing Sheets

METHOD AND APPARATUS FOR TRANSPORTING AND DISPLAYING NECKTIES

BACKGROUND OF THE INVENTION

1. Field of the Invention

The present invention relates to the combination of revolvable racks for transporting, displaying and hanging mens'neckties, and a container for shipping the rack while it is fully loaded with ties.

2. Discussion of the Prior Art

The problem of efficiently organizing and storing neckties has always been a virtual nightmare for modern man. Over the years, many attempts have been made to solve this problem. Specifically, U.S. Pat. No. 2,459,417 to Dodoe teaches a portable rack for suspending wearing apparel and the like from rods in closets, edges of shelves and the like, involving a wheel with radially extending fingers having spring clamps on the upper surfaces thereof, a collapsible supporting bracket with a clip at one end which may be resiliently held over a rod, edge of a shelf or the like, and an arcuate holding element at the other end with a slot in which the wheel can be supported in different positions.

U.S. Pat. No. 2,797,030 to Millhuff discloses a metal wire clothes hanger having a swivel hook. The hook swivels freely about an axis lying normal to the general axis of the arms.

U.S. Pat. No. 2,977,001 is directed to a portable laundry drying rack including a main support member having a plurality of spacer rod sections connected together in longitudinally aligned relationship by a coupling member and a hook end 21.

U.S. Pat. No. 3,133,643 to Lester teaches a clamp-on tie hanger incorporating a split metal narrow clamping ring and tie supporting pins.

U.S. Pat. No. 3,225,977 to Gandy teaches an apparatus for hanging a plurality of clothes. A hook allows the apparatus to hang from a rod or bar.

U.S. Pat. No. 3,228,738 to Koffler teaches an article of luggage or the like, incorporating removable hanger supports and hooks mounted on the luggage.

U.S. Pat. No. 3,289,985 to Sheiman teaches an external hanger for a garment carrying bag having a hook which can be swung between an operative and an idle position.

U.S. Pat. No. 3,896,931 to Franklin concerns a hanger for ready-to-install pleated drapery panels, incorporating a coat hanger-like wire loop frame, a removable horizontal crossbar or shaft, a plurality of clamps and a J-shaped suspension hook.

U.S. Pat. No. 3,978,594 to Pulitzer et al discloses a floor standing display and merchandizing device for ties incorporating a rotatable frame and rack for hanging ties.

U.S. Pat. No. 4,709,838 to Campbell teaches an apparatus for hanging articles of clothing or the like in a closet, involving a hook on one end and elongated, vertically extending clothing hanging hooks.

None of the prior art patents solve the age-old problems associated with neckties however, in the manner presented by the instant invention. The instant tie rack invention offers a way of displaying a lot of neckties in a very little space. The rack can be hung from any conventional bar or rod, arrives fully assembled and stocked, and requires no special tools or skills to install. The rack can either hook onto a rod or bar, or it can be fastened to the bar or rod by a clamp that may be bolted in place.

SUMMARY OF THE INVENTION

It is an object of the present invention to provide a time saving and economical apparatus for transporting, hanging and displaying neckties.

It is a further object of the present invention to provide a transportable, revolvable apparatus for hanging and displaying neckties.

It is another object of the present invention to provide a relatively inexpensive revolvable apparatus for hanging and displaying neckties that is adaptable for suspension from a conventional rod or bar, or from a merchandising fixture.

It is also an object of the invention to provide a carton for shipping the neckties while they are hanging from the display apparatus.

It is yet another object of the invention to provide a labor saving method of shipping or storing neckties, an inexpensive revolvable rack for neckties that can be either temporarily or permanently hooked or fastened to a rod or a store fixture, and a container for shipping the rack while it is fully loaded with ties. The tie rack is easily rotated by hand, has a relatively small turning radius and has the capacity to hold several dozen ties. Once the tie rack is placed in the container, the container serves to both store and protect the ties in an organized and out-of-the-way manner. The container allows the fully loaded tie rack to be quickly and easily lifted out of the container in one smooth motion, and directly hung on a rod or on a merchandising fixture in a store, such that the ties are readily and pleasingly displayed. The present invention offers a tremendous labor saving advantage over prior art arrangements, and is also economical to use. Set-up time for the present invention is less than two minutes, compared to fifteen minutes to thirty minutes required for conventional systems.

BRIEF DESCRIPTION OF THE DRAWINGS

The foregoing objects and advantages of the present invention will become apparent through consideration of the following description when taken in conjunction with the accompanying drawings, wherein.

DETAILED DESCRIPTION OF THE PREFERRED EMBODIMENT

Figure 1:
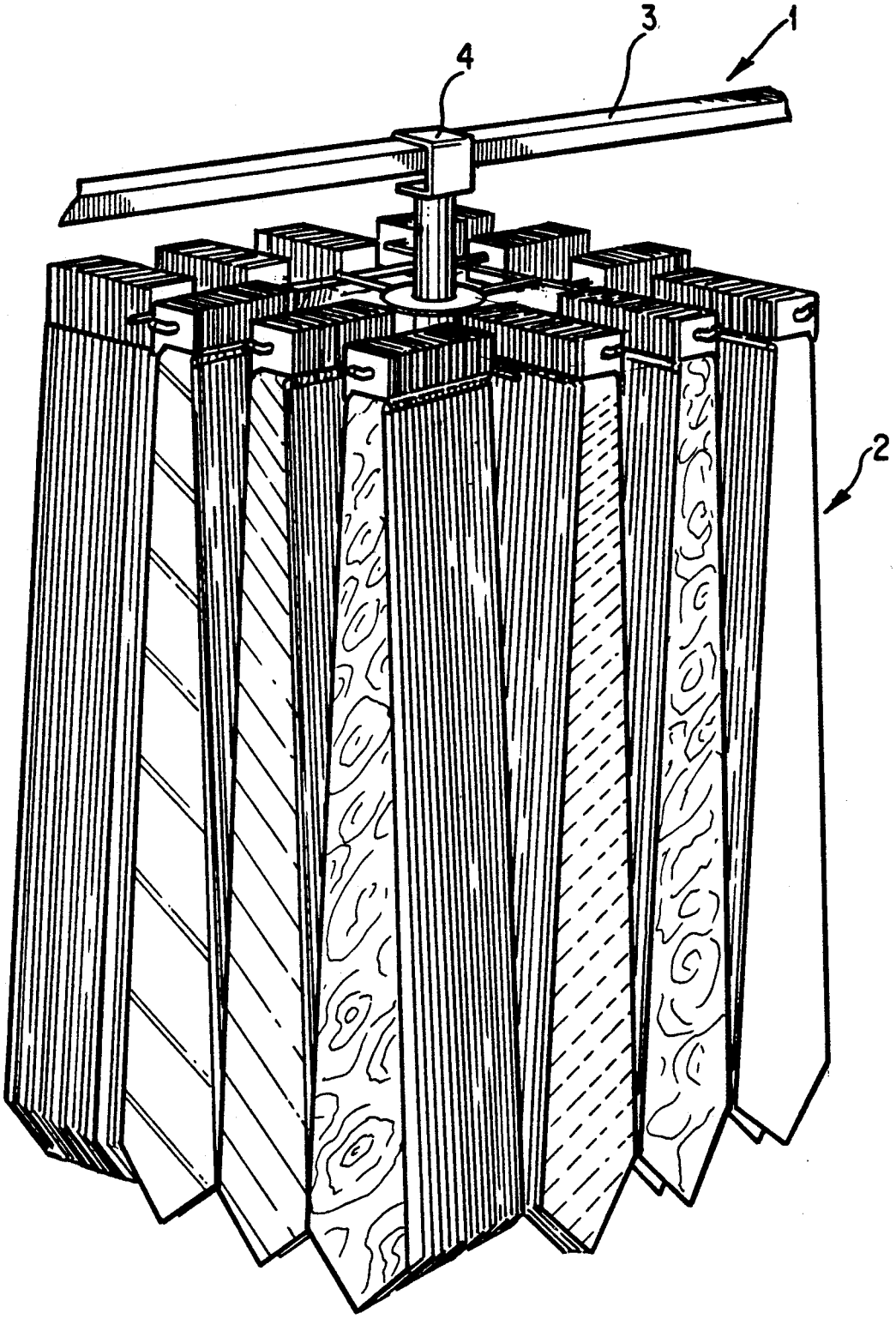
FIG. 1 is a perspective view of the apparatus installed upon a rod and loaded with neckties.

Turning now to the drawings, FIG. 1 shows the tie rack 1 (also referred to herein as simply the rack), fully loaded with neckties 2, in its hanging position upon the bar or rod 3. The tie rack 1 is reliably hung upon the bar or rod 3, by a hook-like member 4 which can merely be seated upon the bar or rod 3. No special tools, equipment or fittings are needed to position and install the tie rack 1 on the bar or rod 3.

The tie rack 1 need not just be installed in a closet, but can also be hung upon any suitable display fixture in a store or other point of sale location. The tie rack 1 is revolvable, thereby enhancing its usefulness as a merchandising fixture. In fact, the principal feature of the tie rack is that it revolutionizes the merchandising of neckties 2, by being easily removed from a transportable container and quickly set up to display the ties in a manner that would encourage purchasers to make a selection. The tie rack 1 allows the use of a small space to accommodate a lot of product.

It can readily be understood that the rack 1 can also be used to display any slender article of clothing such as socks or folded scarves, in which case the rack 1 can be seen as being quite versatile in its usefulness, although as herein described, as a preferred embodiment, the tie rack 1 will be discussed in terms of displaying neckties 2.

Figure 2:
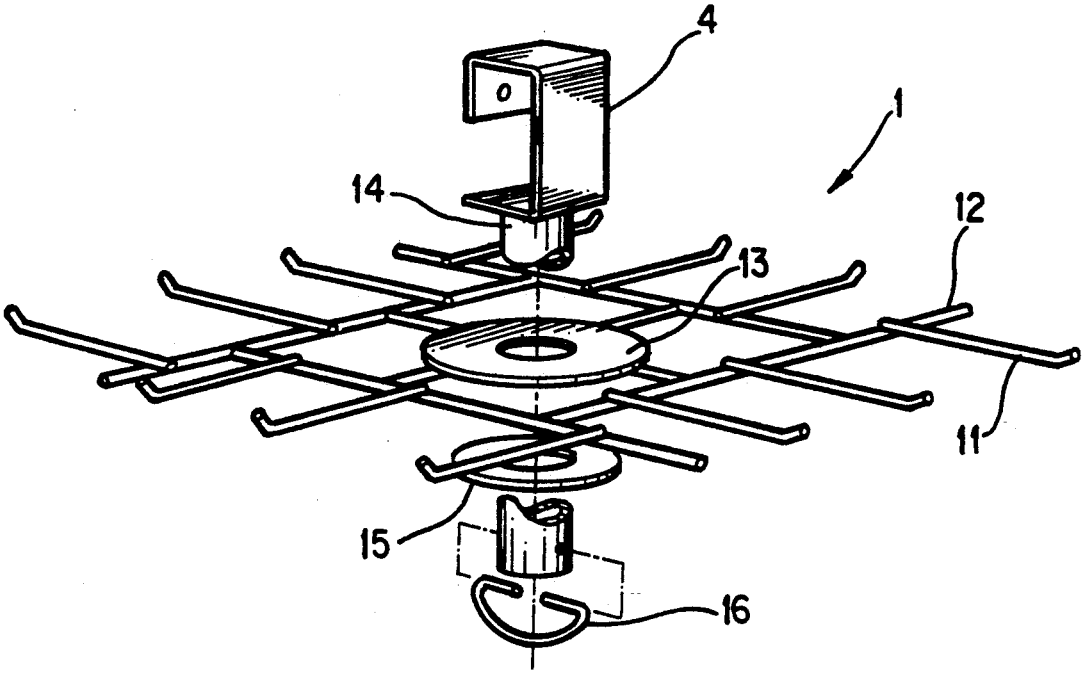
FIG. 2 is an exploded view of the apparatus.

Referring next to FIG. 2, where the details of the tie rack 1 are presented in an exploded view, it can be seen that the hook 4 which serves to hang the rack 1 upon any transversely extending support member is connected to a four-sided frame made up of skeletal wire members 12, outwardly extending fingers or tines 11, a bearing plate 13 and a connecting rod 14. The wire members 12 and the fingers or tines create an apparatus capable of supporting at least several dozen neckties that are either fastened to their merchandising hooks, which are known in the trade as "riders," or that may be draped directly upon the wire members 12 and/or the tines 11 in what could be considered an organized arrangement, or just haphazardly placed in any which way. The neckties 2 can simply be draped over the tines on the wire members 12. But, needless to say, if the rack 1 is serving to present neckties 2 for sale in a store, then the ties should be arranged upon and suspended from the tines 11 in an orderly manner.

Thus, it can readily be seen by the fact that the frame is made up of wire members 12, neckties 2 can be hung from the wire members 12 directly, and need not only be hung from the tines 11.

The wire members 12 are joined to one another and to the tines 11 in any reliable manner so as to give the frame structural rigidity that is suitable for supporting at least several dozen neckties. It is conceivable that the manner of joining may be, for instance, welding, soldering, lashing, etc. It is also conceivable that the tines 11 and wire members 12 can be made in one piece, such as by stamping from a single flat piece of material.

The frame, being four-sided, has the same dimensions on all sides, and any dimension is conceivable, from a measurement as small as 12 inches for use in tight spaces, or as large as is necessary to serve the needs of a busy haberdashery.

In the preferred embodiment, the tines 11 and wire members 12 have a circular cross-section, and are made of a light-weight but strong metal, such as aluminum, steel rod stock or an alloy. But, in another embodiment, the entire frame can be molded of a strong but light-weight plastic. If molded of plastic, the entire frame can be produced in a single operation consisting of only a few manufacturing steps.

The bearing plate 13 serves as a main load carrying element and support for the entire weight of the wire member 12 with tines 11, and all neckties 2 supported thereon. The bearing plate 13 may be integral with the frame, or may be fastened thereto in any known manner suitable for the purpose. The plate 13 is flat, but of a thickness suitable for the purpose of supporting the frame. A circular shape is shown for the plate 13 in FIG. 2, but almost any suitable shape would be acceptable.

The connecting rod 14 is an important element of the tie rack 1. The rod 14 is tubularly shaped, the outer diameter of the tube being of such size that it can pass through a corresponding circular opening in the center position of the plate 13. The rod 14 may be hollow or solid. The rod 14 must be tubular in shape in order to allow the frame to rotate in the plane parallel to the plane of the wire member 12. In another embodiment, the rod 14 is telescoping; that is, it can collapse upon itself for transporting, but can extend to its full length when supporting the full weight of the tie rack 1. The telescoping arrangement of the rod 14 can be any of the known and conventional configurations that may be suitable for sustaining the weight of the fully loaded tie rack 1 and container 30. The telescoping rod 14 attaches to the hook 4 or clamp 18 in any well-known manner. Also, the telescoping rod 14 attaches to the frame in a well-known manner suitable for sustaining the tie rack 1 when it is fully loaded.

The frame rests upon a washer 15, or any similar such component, preferably of the self-lubricating type, such as nylon, so as to facilitate smooth and dependable rotation. The lower part of the rod 14, that is, the region below the washer 15, is provided with fittings for retaining a smooth clip, fastener or pin 16 capable of contacting the underside of the washer 15 so as to support the entire frame. As can clearly be seen in FIG. 2, the member 16 is shown as a C-clip whose ends fit into corresponding holes in the rod 14, but a cotter pin or peg would be equally suitable. In other words, the weight of the frame carrying the neckties 2 is transmitted to the bar or rod 3 via the hook 4 to the bearing 13 through the washer 15 to the member 16.

Figure 3:
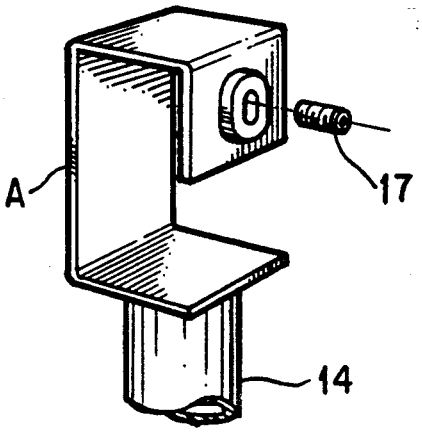
FIG. 3 is a detailed view of the support hook with thumb screw.

Turning now to FIG. 3, a detail of the hook 4, the preferred embodiment, is clearly shown. The rod 14 can be attached to the underside of the hook 4 by any reliable means, such as welding or soldering if the rod 14 and hook 4 are metal. But it is conceivable that both the rod 14 and the hook 4 are to be molded of plastic, in which case the parts can either be formed in one unitary piece, or molded separately and then fastened together in any well-known manner. A set screw 17 can optionally be provided to give additional securement to the bar 3. Although FIG. 3 shows the hook 4 being joined to the top of the rod 14, it can readily be conceived that the rod 14 can be joined to the rear face of the hook 4.

Figure 4:
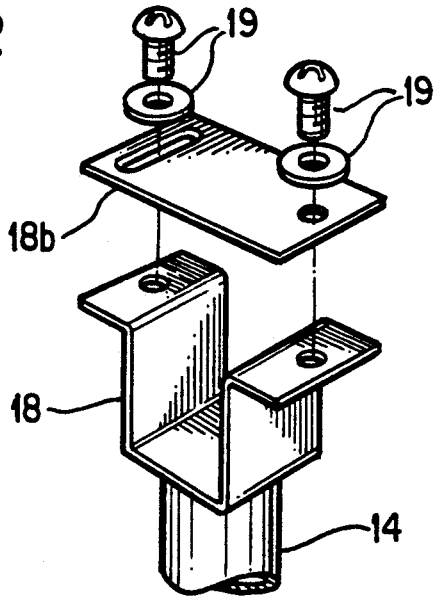
FIG. 4 is an exploded view of a bracket and clamp that may be used to support the apparatus.

FIG. 4 shows a bracket assembly 18 which can serve as an alternative to using the hook 4 shown in FIGS. 1–3. The bracket assembly 18 involves a bracket body 18*a* and a bracket plate 18*b* which fastens to the bracket body 18*a* by suitable screws and washers 19. The bracket body 18*a* must be of dimensions compatible with the dimensions of the bar 3, so that the bracket assembly 18 fits properly around the bar 3. This alternative provides greater strength and permanence than the preferred embodiment, is more difficult to install, but can sustain more load carrying weight, thus would be recommended for a larger tie rack.

Figure 5A:
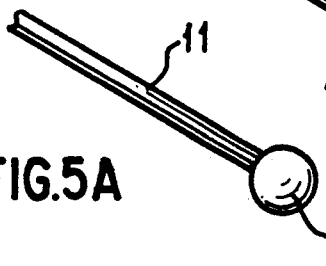
FIG. 5 is a detailed view of the ends of the tines of the apparatus.
Figure 5B:
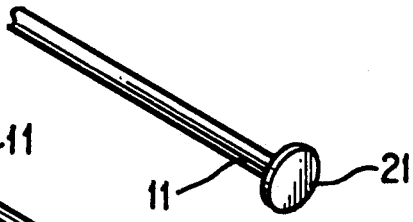
Figure 5C:
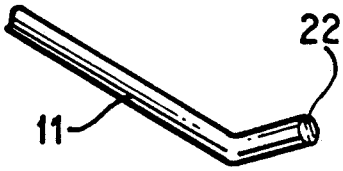

Details of the outer ends of the tines 11 are shown in FIG. 5. The ends of the tines 11 can either be a ball 20 or a plate 21, both of which can be chosen for their decorative and aesthetic properties, rather than mechanical aspects. The ball 20 or plate 21 also serves to prevent neckties from sliding off of the tines 11. In addition, the tines 11 may simply have an upwardly turned hook 22, which is capable of preventing the ties from falling off.

Figure 6:
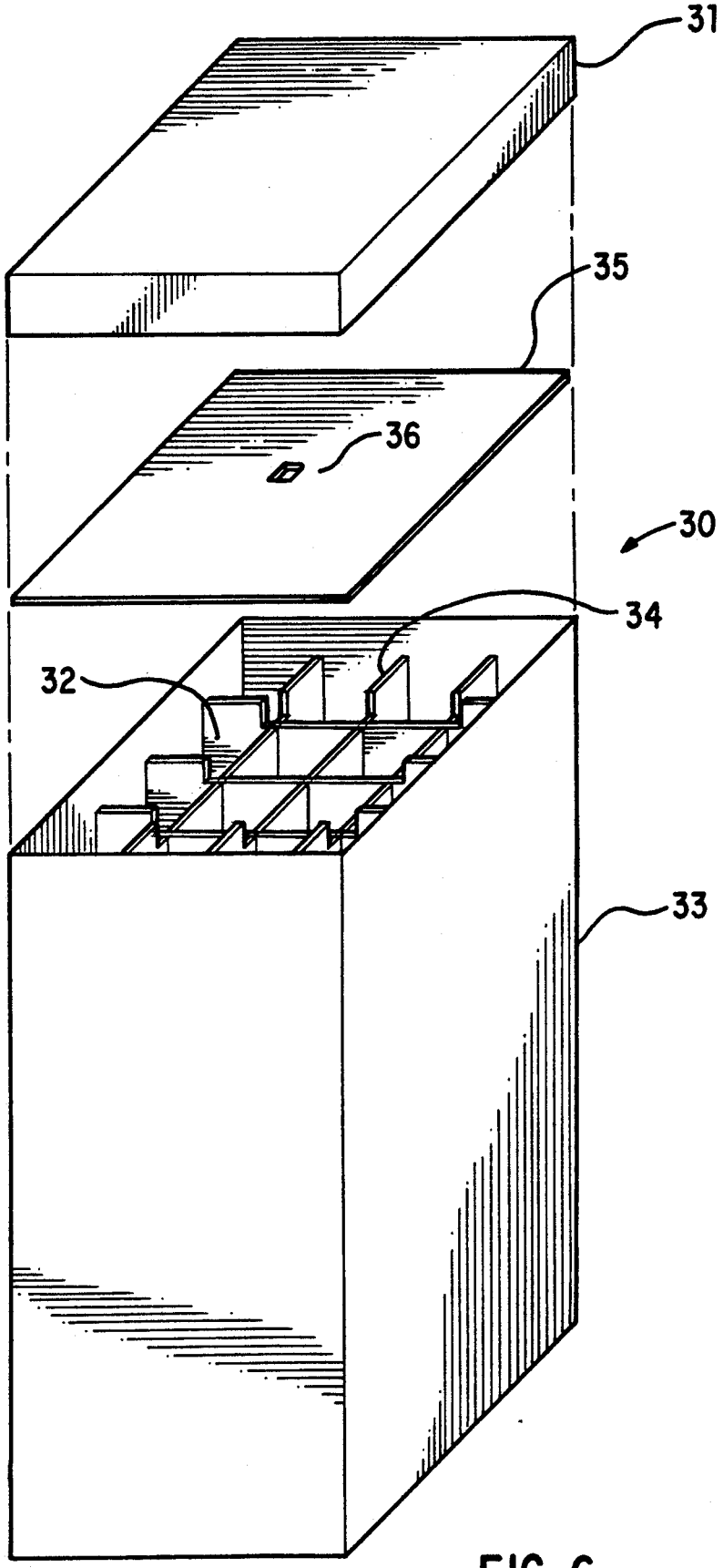
FIG. 6 shows an overall view of the enclosure, the compartments and a lid.

FIG. 6 depicts the integral container or carton 30 used for shipping the tie rack 1 while it is loaded with ties 2. The carton 30 has a square cross-section and involves only four main parts, namely the box 33, the internal dividers or partitions 34 and a lid 31. The partitions 34 divide the interior of the box 33 into compartments 32 suitable for surrounding the neckties while they hang from the tie rack, in a manner to be described later. The lid 31 closes and seals the top of the box 33 so as to prevent the neckties 2 from falling out of the box 33 or becoming soiled during shipping and transporting.

A positioner 35 serves to hold the neckties 21, while on their respective riders, on the frame or on the tines 11. The positioning member 35 sits atop the tie rack 1 once the rack 1 is located within the box 33, and prevents the ties 2 from falling off of the rack 1 or otherwise becoming disturbed. The positioner 35 is flat, thin and has the same shape as the cross-section of the box 33, but has slightly larger dimensions so that the positioner 35 friction fits against the interior sides of the box 33, so as to offer a snug fit. The positioner 35 can be made of almost any lightweight but strong material, such as that used for all other materials in the container 30, but the positioner 35 can be made of other materials that are suitable for the purpose of holding the neckties 2 in place on the tie rack 1 while inside the container 30. The positioner 35 has an opening 36 in its center through which the hook 4 or clamp 18 can pass. The opening 36 must be at least the same size as the connecting rod 14. The positioner 35 does not interfere with the lid 31 in place on top of the box 33.

The lid 31 may either be integral with the box 33, such as fold-over flaps or the like, located at the top of the box 33. The lid 31 can also be completely separate from the box 33, as shown in FIG. 6.

If the lid 31 is not integral with the box 33, as shown in FIG. 6, then the lid 31 must be suitably fastenable to the box 33, such that the lid 31 cannot be easily removed, or will not fall off in case the box 33 is upset or falls over.

The integral container or carton 30, which has at least the same size and dimensions as the tie rack 1, protects the neckties 2 contained therein from the damaging effects encountered when the neckties are shipped. The neckties 2 arrive at their destination in a clean and pressed manner that gives them a fresh-from-the-factory appearance. It can readily be seen that the compartments 32 must be equal in number to the number of tines 11 carried by the frame, so that the group or bundle of neckties hanging on each individual tines 11 is made to fill a single compartment 32 in a vertically hanging fashion.

Figure 7:
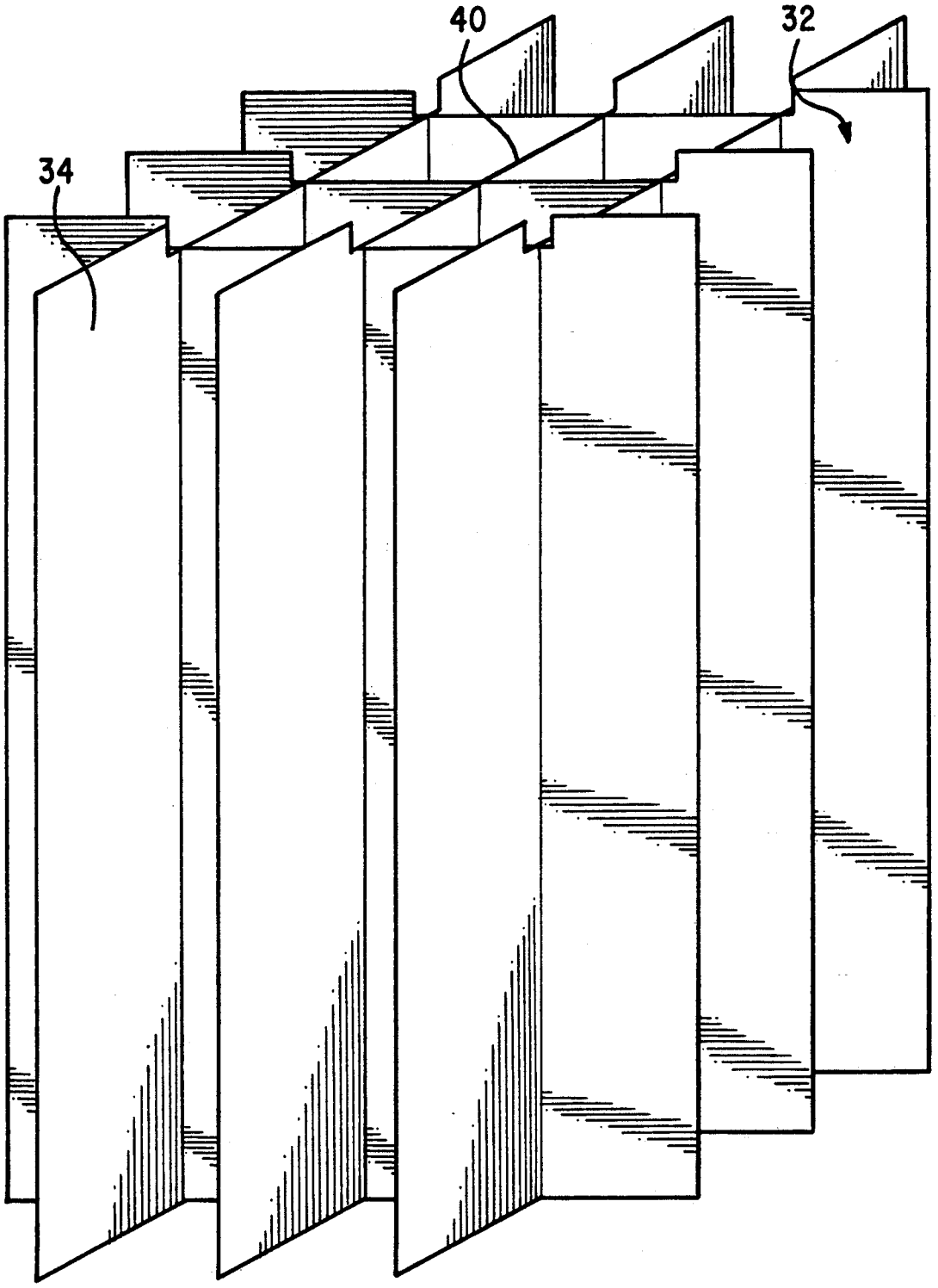
FIG. 7 is a detailed view of the compartments.

The manner in which the ties 2 occupy the compartments 32 will now be described with reference to FIG. 7, together with the remaining FIGURES. The compartments 32 are formed by the dividers or partitions 34. The dividers 34 have a recessed region 40 which is located on the innermost part of the upper edge surface of the dividers 34. The dimensions of the recess 40 directly correspond to the dimensions of the wire member 12.

Figure 9:
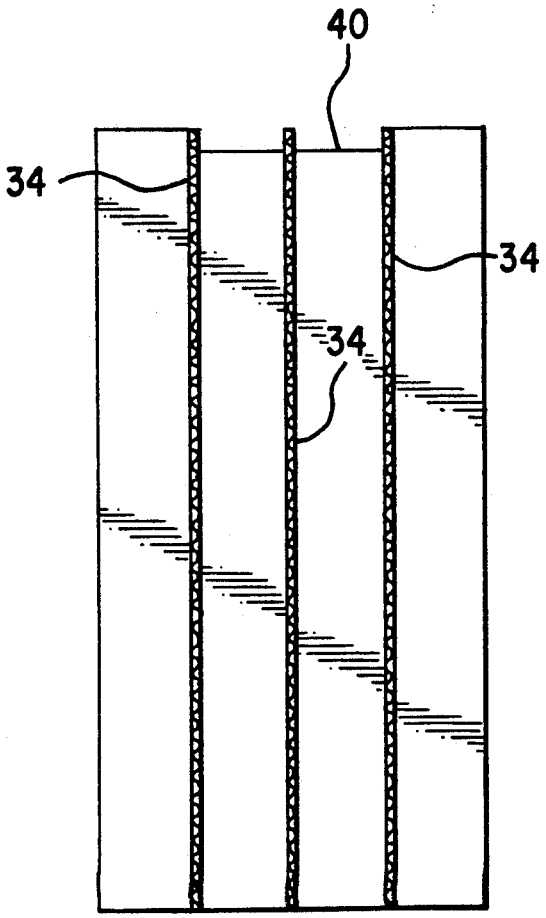
FIGS. 8 and 9 show a side view of the compartments.
Figure 8:
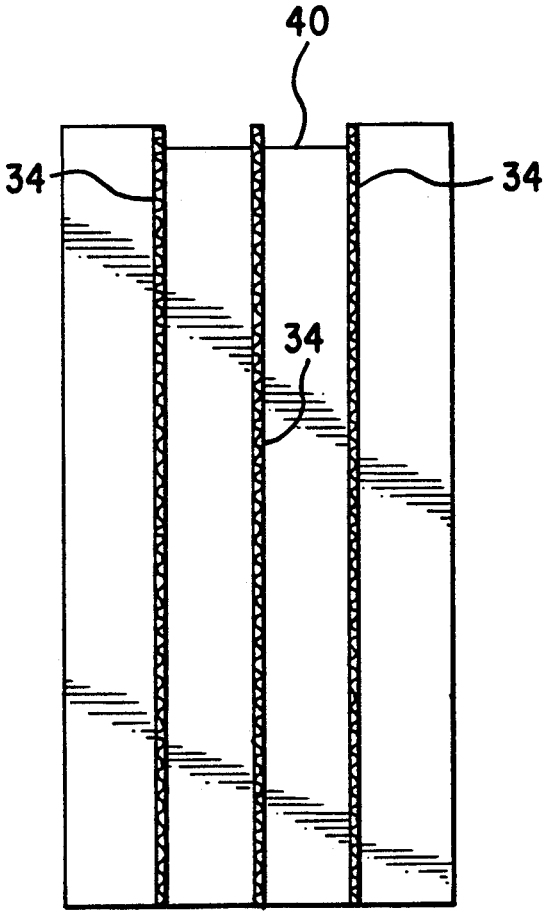

As can most clearly be seen in FIGS. 8 and 9, the recess region 40 is permanently formed on the top of the center part of the dividers 34 only, and does not extend completely to the outer edges of the dividers 34. The actual size and shape of the recess region 40 conforms to the size and shape of the tie rack frame, which is clearly shown in FIG. 2, such that the tie rack frame rests within the recess 40 in a nestled fashion.

Figure 10:
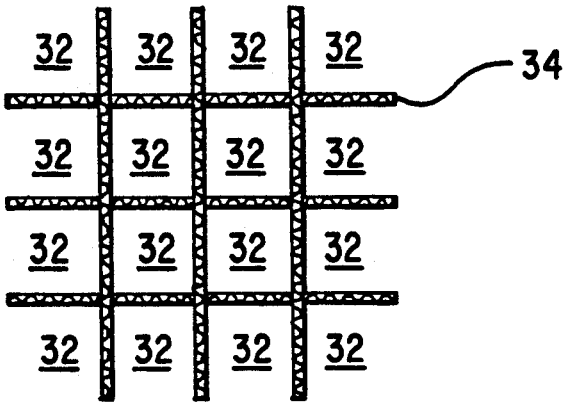
FIG. 10 is a plan view of the compartments.

FIG. 10 is a top or plan view of the dividers 34, showing the compartments 32. The compartments 32 are of the size and shape necessary to accommodate the neckties 2 as they hang from the tie rack 1, which itself is nestled atop the dividers 34 in the recess 40. The recess 40 cannot be clearly seen in FIG. 10, because of the top or plan view which is shown therein.

The dividers or partitions 34 can be made of any material offering suitable rigidity and mechanical strength capable of supporting and sustaining the fully loaded tie rack 1. In the preferred embodiment, the dividers or partitions 34 are formed of corrugated cardboard, as are both the lid 31 and the box 33. Corrugated cardboard is chosen for its well-known properties of light weight, low cost and mechanical strength. As a further precaution, the corrugated cardboard used for construction of the lid 31 and the box 33 can be coated with a water-repellant coating to add an additional layer of protection for the neckties 2 contained within the box 33. It was well within contemplation of the present invention that the box 33 be made of a strong but transparent material so as to allow the contents of the box 33 to be openly viewed and regarded for their visual appeal. As an alternative, a portion of the sides of the box 33, or any or all sides of the box 33, can be provided with a transparent panel also for the purpose of allowing the neckties 2 contained within the box 33 to be viewed. Selection of the strong but transparent material may depend upon, among other things, cost, weight, etc. Furthermore, the transparent material may be any attractive and pleasing color or shade, which quite possibly could be used to indicate a particular manufacturer, destination or style of necktie 2. Similarly, either or both the lid 31 or box 33 can carry indicia setting forth relevant information about the ties 2 which is desired to be disclosed.

In the preferred embodiment, the lid 31 and the box 33 are reusable. However, it is conceivable that they each can be disposable, such that, after one or possibly two uses, both the lid 31 and the box 33 can be discarded or processed for environmental recycling when no longer needed, in any well-known manner.

FIGS. 11–14 show details of the dividers 34. The dividers 34 can be manufactured in any well-known manner, and in the preferred embodiment, the dividers 34 are also made of corrugated cardboard. However, the dividers 34 can be made of plastic, paperboard, or any other material suitable for the purpose of containing a full load of neckties 2 hanging from the tie rack 1 and supporting the tie rack within the recess 40.

Figure 11:
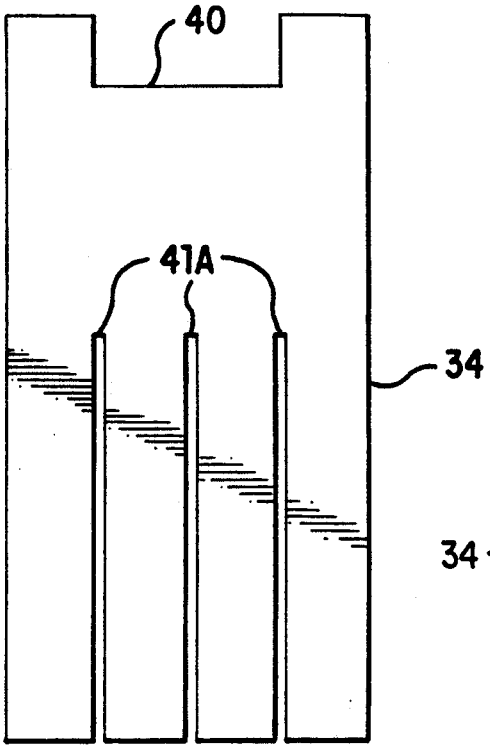
FIGS. 11–14 inclusive, are detailed views of the interlocking panels which form the compartments.
Figure 12:
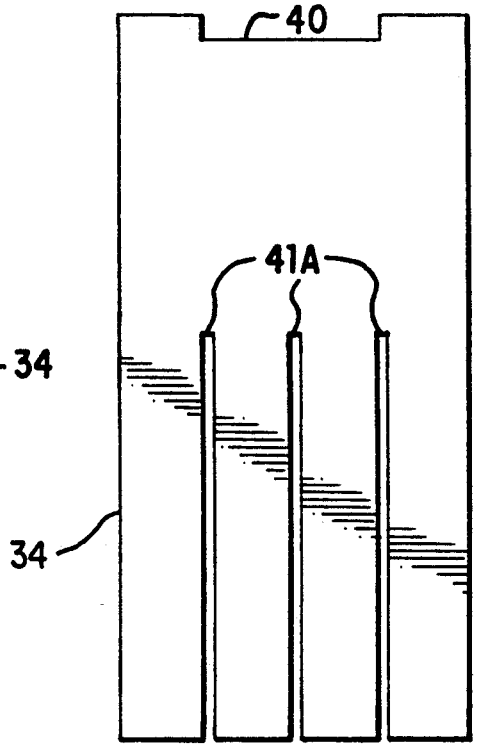
Figure 13:
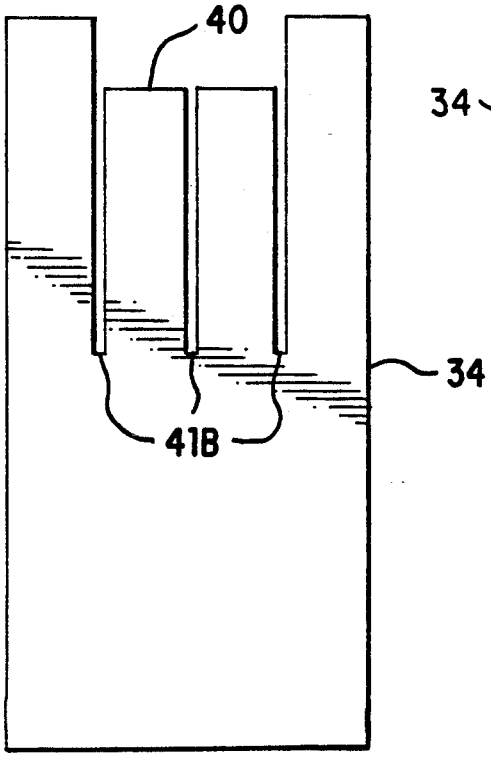
Figure 14:
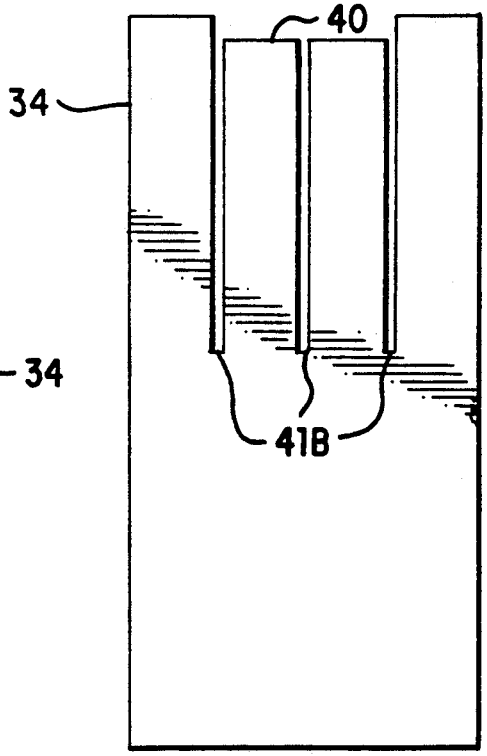

The dividers 34 shown in FIGS. 11 and 12 each mate with the dividers 34 shown in FIGS. 13 and 14 in an interlocking manner, such that the cut-outs 41A intersect with the cut-outs 41B to create the cross-hatched compartmental arrangement shown in FIG. 10. The interlocking of the cut-outs 41A,41B provides the necessary fastening needed to cause the dividers 34 to retain their shape, thus no adhesive or mechanical fastener is needed, which may tend to mar or damage the neckties.

Once inside the container or carton 30, the tie rack 1 is nestled in the recess 40, and snugly set atop the dividers 34. When the tie rack 1 is fully loaded with ties 2, which are suspended from the tines 11, the ties 2 fall neatly into place within the compartments 32. Thus, the neckties 2 can be transported within the container or carton 30 wrinkle-free, and in a safe manner. Once the container 30 arrives at its destination, the lid 31 is removed from the box 33, and the tie rack 1 with the neckties 2 hanging in place is lifted all at once from atop the recess 40, and conveniently hung up for display or selection.

It is conceivable that the container 30 can be used to store the ties 2, while they hang from the rack 1, within the container 30, and the container 30 is sealed by the lid 31. The ties 2 are protected from dust, sunlight——which tends to fade colors——moisture, wrinkling and all other detrimental effects, while enclosed within the container 30. Furthermore, it is conceivable that the container 30 may include a treatment to ward off undesirable pests and insects, such as moths. The instant tie rack 1 and container 30 provide a quick and convenient way to take the ties 2 directly from a manufacturing, shipping, transportation or storage mode, to a more useful mode such as display or selection. With the instant invention, the formerly costly, labor-intensive and time-consuming step of unpacking new neckties from their shipping box, sorting the new neckties and then hanging them up, is effectively eliminated. Instead, with the present invention, the ties can be sorted and hung upon the rack 1 by the manufacturer, and then shipped already in a condition for presentation in a manner conducive to brisk sale.

The present invention easily fits into an existing space and requires no special tools or skills to install. In fact, the maximum amount of time required to set up the present invention is approximately two minutes, which is a tremendous time savings over the present method which may take up to a half-hour to completely set up. Furthermore, due to the fact that the present invention already comes fully assembled and fully stocked, no in-store or in-home service is ever necessary, thereby offering a greater cost and time savings for a busy merchant or businessman.

Although the invention has been herein described in conjunction with a preferred embodiment, and various alternate constructions have been disclosed, it is to be appreciated that various modifications may be made without deviating from the scope of the invention as set forth in the appended claims.

We claim:

1. An apparatus for protecting a plurality of vertically hanging slender articles of clothing, comprising:

a rigid, upright standing containment means, having a square cross-section and an interior divided into a plurality of regular, equally spaced compartments by vertically extending segregating means;

the top-most edge of said segregating means being provided with a central region less than the total width of said containment means, and having a recess so as to form a square, horizontal plane, extending in all directions to the interior edge of the surrounding segregating means;

a closing means adapted to seal the top of said containment means;

a unitary, horizontally disposed and planar slender article supporting means having a vertical center, adapted for location within said containment means;

said supporting means having a means for demountable attachment to a horizontally extending bar or rod, the demountable attachment means being rotatably fastened to said vertical center of said supporting means;

said supporting means having a plurality of outwardly extending means, adapted for supporting the slender articles, the number of slender article supporting means corresponding to the number of equally spaced compartments; and said slender article supporting means having a length, when measured from said vertical center, which is less than one-half of the width of said containment means;

whereby said supporting means is horizontally positionable within said recess of said central region, such that slender articles carried upon said slender article supporting means are located within said compartments, and the entire containment means and supporting means can be sealed by said closing means.

2. The apparatus of claim 1, wherein said slender articles of clothing are neckties.

3. The apparatus of claim 1, wherein said containment means, said segregating means and said closing means are made of corrugated cardboard or paperboard.

4. The apparatus of claim 1, wherein said containment means is transparent.

5. The apparatus of claim 1, wherein said containment means including a removable slender article position securement means disposed between the top of said article supporting means and the bottom of said closing means, said position securement means held in place by friction fit with the interior sides of said containment means, and said position securement means having a centrally located opening through which said demountable attachment means protrudes.

6. The apparatus of claim 1, being adapted to perform a method of transporting vertically hanging slender articles of clothing, said articles of clothing being readily displayable in a hung manner, comprising the steps of:

suspending the articles of clothing from a frame rotatable about a vertical center, said frame adaptable for demountable suspension from a supporting member, by a hook or a clamp, said frame having a plurality of tines adapted for hanging said articles of clothing, said tines extending outwardly in the horizontal plane;

locating the articles of clothing, while said articles of clothing are suspended from either said frame or said tines, within a rigid, vertically extending enclosure, having a square cross-section, a top closure, a number of internal compartments, a number of compartments corresponding to the number of tines, and a planar positioning member disposed between the top of said articles of clothing and the bottom of said top closure, the planar positioning member having a centrally located opening through which said hook or clamp protrudes;

such that articles of clothing suspended from each tine are disposed within an individual compartment, such that the central region of said frame, immediately adjacent said vertical center, is supported by direct contact with the upper edges of said compartments;

smoothly and continuously lifting said frame, carrying said slender articles of clothing, directly out of said rigid enclosure; then suspending said frame, via said hook or clamp, from said horizontally extending bar or rod.

7. The apparatus of claim 6, wherein said slender articles of clothing are neckties.

8. The apparatus of claim 6, wherein said hook or clamp includes a telescoping member operably attached to said frame.

* * * * *